US008933335B2

(12) United States Patent
Citver et al.

(10) Patent No.: US 8,933,335 B2
(45) Date of Patent: Jan. 13, 2015

(54) CURRENT LEAD WITH A CONFIGURATION TO REDUCE HEAT LOAD TRANSFER IN AN ALTERNATING ELECTRICAL CURRENT ENVIRONMENT

(75) Inventors: Gregory Citver, Danvers, MA (US); Frank Sinclair, Quincy, MA (US); D. Jeffrey Lischer, Acton, MA (US); Nandishkumar Desai, Cambridge, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 553 days.

(21) Appl. No.: 13/273,927

(22) Filed: Oct. 14, 2011

(65) Prior Publication Data

US 2013/0092413 A1 Apr. 18, 2013

(51) Int. Cl.
*H01B 5/00* (2006.01)
*H01F 6/06* (2006.01)

(52) U.S. Cl.
CPC ..... *H01F 6/065* (2013.01)
USPC ..... 174/126.1

(58) Field of Classification Search
USPC ..... 174/74 R, 78, 84 R, 88 R, 84 C, 126.1, 174/126.2
See application file for complete search history.

(56) References Cited

U.S. PATENT DOCUMENTS 2,409,659 A * 10/1946 Braddon ..... 33/329
2,438,915 A * 4/1948 Hansen ..... 333/22 R
3,054,074 A * 9/1962 Bird et al. ..... 333/22 R
3,158,823 A * 11/1964 Bird et al. ..... 333/22 R
3,183,458 A * 5/1965 Goldfinger ..... 333/22 R
3,902,000 A * 8/1975 Forsyth et al. ..... 174/15.3
3,909,755 A * 9/1975 Kaunzinger ..... 333/206
4,260,962 A * 4/1981 Dydyk ..... 333/22 R
4,895,831 A * 1/1990 Laskaris ..... 505/163
4,902,995 A * 2/1990 Vermilyea ..... 505/211
5,369,367 A * 11/1994 Eisenhart ..... 324/632
5,508,669 A * 4/1996 Sugawara ..... 333/206
6,528,751 B1 * 3/2003 Hoffman et al. ..... 219/121.43
8,173,897 B2 * 5/2012 Hirose et al. ..... 174/15.5
2003/0222639 A1 * 12/2003 Slates ..... 324/207.16
2005/0104579 A1 * 5/2005 Slates ..... 324/207.16
2007/0179062 A1 * 8/2007 Hirose et al. ..... 505/230
2009/0170706 A1 * 7/2009 Hirose et al. ..... 505/163
2009/0197769 A1 * 8/2009 Hirose ..... 505/163

FOREIGN PATENT DOCUMENTS

EP 350268 A2 1/1990
EP 1830445 A1 9/2007

OTHER PUBLICATIONS

Niemann, R.C., et al., High-Temperature-Superconductor Current Leads for Electric Utility Superconducting Magnetic Energy Storage Applications, Proceedings of the Intersociety Energy Conversion Engineering Conference, Jul. 30, 1995, pp. 293-299, vol. CONF. 30, United States.

(Continued)

*Primary Examiner* — William H Mayo, III

(57) ABSTRACT

A current lead with a configuration to reduce heat load transfer in an alternating electrical current (AC) environment is disclosed. The current lead may comprise a conductive material having a configuration for reducing heat load transfer across the current lead when an alternating electrical current (AC) is applied to the current lead. A temperature gradient a may be exhibited along a length of the current lead.

21 Claims, 8 Drawing Sheets

(56) References Cited

OTHER PUBLICATIONS

Buyanov, Yu. L., Current leads for use in cryogenic devices. Principle of design and formulae for design calculations, Cryogenics, Feb. 1985, pp. 94-98, vol. 25, Butterworth & Co. (Publishers) Ltd., London, United Kingdom.

Zeimetz, B., et al., General design formula for tapered, conduction-cooled current lead utilizing high temperature superconducting tapes, Superconductor Science and Technology, 1999, pp. 181-183, vol. 12, IOP Publishing Ltd., United Kingdome.

Wilson, Martin N., Current Supply, Superconducting Magnets, 1983, pp. 256-278, Chapter 11, Oxford Science Publications, Oxford, United Kingdom.

* cited by examiner

200

CURRENT LEAD WITH A CONFIGURATION TO REDUCE HEAT LOAD TRANSFER IN AN ALTERNATING ELECTRICAL CURRENT ENVIRONMENT

FIELD OF THE DISCLOSURE

The present disclosure relates generally to a current lead and, more particularly, to a current lead with a configuration to reduce heat load transfer in an alternating electrical current environment.

BACKGROUND OF THE DISCLOSURE

In electric power transmission and distribution networks, fault current conditions may occur. A fault current condition is an abrupt surge in the current flowing through the network caused by a fault or a short circuit in the network. Causes of a fault may include lightning striking the network, and downing and grounding of transmission power lines due to severe weather or falling trees. When a fault occurs, a large load appears instantaneously. In response, the network delivers a large amount of current (i.e., overcurrent) to this load or, in the case, the fault. This surge or fault current condition is undesirable and may damage the network or equipment connected to the network. In particular, the network and the equipment connected thereto may burn or, in some cases, explode.

One system used to protect power equipment from damage caused by a fault current is a circuit breaker. When a fault current is detected, the circuit breaker mechanically opens the circuit and disrupts overcurrent from flowing. Because a circuit breaker typically take 3 to 6 power cycles (up to 0.1 seconds) to be triggered, various network components, such as transmission lines, transformers, and switchgear, may still be damaged.

Another system to limit a fault current and to protect power equipment from damage caused by a fault current is a superconducting fault current limiter (SCFCL) system. Generally, an SCFCL system comprises a superconducting circuit that exhibits almost zero resistivity below a critical temperature level $T_C$, a critical magnetic field level $H_C$, and a critical current level $I_C$. If at least one of these critical level conditions is exceeded, the circuit quenches and exhibits resistivity.

During normal operation, the superconducting circuit of the SCFCL system is maintained below the critical level conditions of $T_C$, $H_C$, and $I_C$. During a fault, one or more of the aforementioned critical level conditions is exceeded. Instantaneously, the superconducting circuit in the SCFCL system is quenched and resistance surges, which in turn limits transmission of the fault current and protects the network and associated equipment from the overload. Following some time delay and after the fault current is cleared, the superconducting circuit returns to normal operation wherein none of the critical level conditions are exceeded and current is again transmitted through the network and the SCFCL system.

The SCFCL system may operate in a direct electrical current (DC) or an alternating electrical current (AC) environment. If the SCFCL operates in an AC environment, there may be steady power dissipation from AC losses (i.e., superconducting thermal or hysteresis losses), which may be removed by a cooling system. Current leads, typically in the form of wires, are typically used to transmit electrical energy or signals in the SCFCL system. However, traditional current leads used in SCFCL systems that operate in AC typically result in substantial heat loss. As a result, optimizing current lead shape and configuration to minimize heat loss may be an important factor to consider by manufacturers.

Accordingly, in view of the foregoing, it may be understood that there may be significant problems and shortcomings associated with current technologies for current leads used in AC applications.

SUMMARY OF THE DISCLOSURE

A current lead with an optimized configuration to reduce heat load transfer in an alternating electrical current (AC) environment is disclosed. In one particular exemplary embodiment, the current lead may comprise a conductive material having a configuration for reducing heat load transfer across the current lead when an alternating electrical current (AC) is applied to the current lead. A temperature gradient a may be exhibited along a length of the current lead.

In accordance with other aspects of this particular embodiment, the at least one of the conductive material and the configuration may comprise temperature-dependent characteristics associated with joule heating and conduction to reduce heat load transfer.

In accordance with further aspects of this particular embodiment, the current lead may be made of two or more materials bonded along a length of the current lead to reduce heat load transfer.

In accordance with additional aspects of this particular embodiment, the conductive material may comprise a cylindrical shape and the configuration comprises a hollow portion within the conductive material. In some embodiments, the hollow portion may comprise a tapered conical shape. In some embodiments, the hollow portion may comprise a stepped, conical shape having two or more segments.

In accordance with other aspects of this particular embodiment, the current lead is an integrated current lead formed by two or more independent current leads along a length of the integrated current lead, wherein each of the two or more independent segments has an overall cross-sectional diameter that is approximate to the other independent segments.

In accordance with further aspects of this particular embodiment, the configuration may comprise a tapered conductive material and a hollow portion within the conductive material.

In accordance with additional aspects of this particular embodiment, the configuration may comprise a tapered conductive material.

In accordance with other aspects of this particular embodiment, the current lead may further comprise an insulating material configured to cover at least part of a surface of the current lead. In some embodiments, the insulating material may be attached to at least part of the outer surface of the conductive material.

In accordance with further aspects of this particular embodiment, the current lead may be configured for use in a superconducting (SC) system. In some embodiments, the superconducting (SC) system may comprise at least one of a superconducting fault current limiter (SCFCL) system, a superconducting (SC) magnet system, and a superconducting (SC) storage system.

In accordance with additional aspects of this particular embodiment, the current lead is an integrated current lead formed by two or more independent current leads along a length of the integrated current lead.

In accordance with other aspects of this particular embodiment, the current lead may have different shapes for different alternating electrical current (AC) input frequencies.

In accordance with further aspects of this particular embodiment, the current lead may further comprise one or more electrical inputs at one or more points along a length of the current lead, and one or more electrical outputs at one or more points along the length of the current lead.

In another particular embodiment, a superconducting (SC) system may be provided. The superconducting (SC) system may comprise a conductive material having a configuration for reducing heat load transfer across a current lead when an alternating electrical current (AC) is applied to the current lead, wherein temperature gradient is exhibited along a length of the current lead.

In yet another particular embodiment, a method of manufacturing a current lead may be realized. The method may comprise providing a first current lead. The first current lead may comprise a first conductive material having a first hollow portion. The first conductive material and the first hollow portion may be cylindrical in shape such that a diameter of the first conductive material may be greater than a diameter of the first hollow portion. The method may also comprise providing a second current lead. The second current lead may comprise a second conductive material having a second hollow portion. The second conductive material and the second hollow portion may be cylindrical in shape such that a diameter of the second conductive material may be greater than a diameter of the second hollow portion, and the diameter of the first conductive material may be approximately the same as the diameter of the second conductive material and the diameter of the first hollow portion may be different than the diameter of the second hollow portion. The method may further comprise attaching the first current lead with the second lead at respective ends of each of the first current lead and the second current lead to form an integrated current lead with a configuration for reducing heat load transfer across the integrated current lead when an alternating electrical current (AC) is applied to the integrated current lead. Temperature fluctuation or gradient may be exhibited along a length of the integrated current lead.

The present disclosure will now be described in more detail with reference to particular embodiments thereof as shown in the accompanying drawings. While the present disclosure is described below with reference to particular embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be exemplary only.

DETAILED DESCRIPTION OF EXEMPLARY EMBODIMENTS

Embodiments of the present disclosure provide a current lead with an optimized configuration to reduce heat load transfer in an alternating electrical current (AC) environment.

A superconducting fault current limiter (SCFCL) system may comprise an enclosure electrically decoupled from ground, such that the enclosure is electrically isolated from a ground potential. In some embodiments, the enclosure may be grounded. The SCFCL system may also have first and second terminals, electrically connected to one or more current carrying lines, and a first superconducting circuit contained within the enclosure, wherein the first superconducting circuit may be electrically connected to the first and second terminals.

Figure 1:
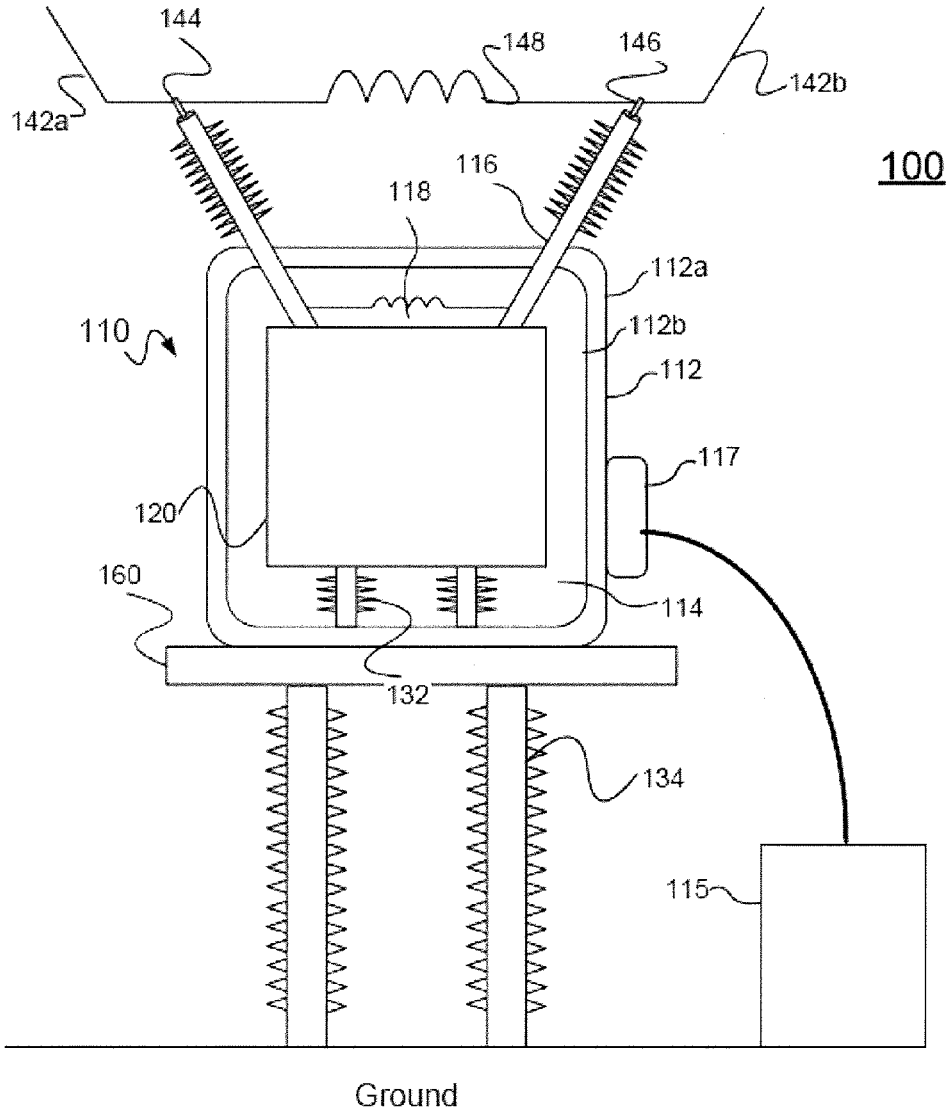
FIG. 1 depicts a superconducting fault current limiter (SCFCL) system using current leads according to an embodiment of the present disclosure.

Referring to FIG. 1, there is shown an exemplary system using current leads according to an embodiment of the present disclosure. In the present embodiment, a superconducting fault current limiter (SCFCL) system 100 using current leads is shown. Although the present embodiment focuses on SCFCL system 100, it should be appreciated that the present disclosure is not limited thereto. Those skilled in the art should recognize that other electrical system comprising current leads that are exposed to varying temperatures will be just as applicable.

The SCFCL system 100 of the present embodiment may comprise one or more modules 110. For the purposes of clarity and simplicity, the description of SCFCL system 100 will be limited to one single phase module 110 although various other embodiments using more than one phase module may be contemplated in accordance with the present disclosure.

The phase module 110 of SCFCL system 100 may comprise an enclosure or tank 112 defining a chamber therein. In one embodiment, the enclosure or tank 112 may be thermally insulated. In other embodiments, the enclosure or tank 112 may be electrically insulated. The enclosure or tank 112 may be made from a variety of materials, such as fiberglass or other dielectric materials. In other embodiments, the enclosure or tank 112 may be made of an electrically conductive material, such as metal (e.g., stainless steel, copper, aluminum, or other metal). The enclosure of tank 112 may also comprise an outer layer 112*a* and an inner layer 112*b*. An insulating medium (e.g., a thermal and/or electrically insulating medium) may be interposed between the outer layer 112*a* and the inner layer 112*b*.

In some embodiments, the enclosure or tank 112 may or may not be connected to earth ground. In the configuration depicted in FIG. 1, the enclosure or tank 112 is not connected to earth ground, and thus may be referred to as a floating tank configuration.

Within the enclosure or tank 112, there may be one or more fault current limiting units 120, which, for the purpose of clarity and simplicity, are shown as a block. The module 110 may also comprise one or more electrical bushings 116. Distal ends of the bushings 116 may be coupled to transmission network current lines 142*a* and 142*b* via terminals 144 and 146, respectively. This configuration may allow the module 110 to be coupled to a transmission network (not shown). The current lines 142*a* and 142*b* may be transmission lines to transmit power from one location to another (e.g., current source to current end users), or power or current distribution lines.

The bushings 116 may comprise current leads having inner conductive material that connects the terminals 144 and 146 to the fault current limiting unit 120. Meanwhile, the outer layer 112*a* may be used to insulate the enclosure or tank 112 from inner conductive material, thereby allowing the enclosure or tank 112 and the terminals 144 and 146 to be at different electrical potentials. In some embodiments, the module 110 may comprise an internal shunt reactor 118 or an external shunt reactor 148, or both, to connect the conductive material contained in the electrical bushings 116.

Several insulated supports may be used to insulate various voltages from one another. For example, insulated supports 132 within the enclosure or tank 112 may be used to isolate the voltage of the module 120 from the enclosure or tank 112. Additional supports 134 may be used to isolate a platform 160 and the components resting thereon from ground.

The temperature of the fault current limiting unit 120 may be maintained at a desired temperature range using coolant 114 in the enclosure or tank 112. In some embodiments, the fault current limiting unit 120 may be cooled and maintained at a low temperature range, for example, at or around ~77° K. The coolant 114 may include liquid nitrogen or other cryogenic fluid or gas. The coolant 114 itself may be cooled using an electrical cooling system, which may further comprise a cryogenic compressor 117. Other types of cooling systems may also be used to keep the coolant 114 at low temperatures.

A portion of the current leads near terminals 144 and 146 may reside in ambient or room temperatures whereas another portion of the current leads near the module 110 or fault current limiting unit 120 may reside in low temperatures. This difference in temperature and environment may have an effect on the current leads. Substantial heat loss may be exhibited in the current leads, as well as other adverse effects. In applications using alternating electrical current (AC), for example, these effects may be heightened.

For instance, a phenomenon referred to as "skin effect" may also result. In applications using alternating electrical current (AC), current density may be highest at or near a surface or "skin" of a current lead. The skin effect may be caused by opposing eddy currents induced by changing magnetic field resulting from the alternating electrical current (AC).

Figure 2:
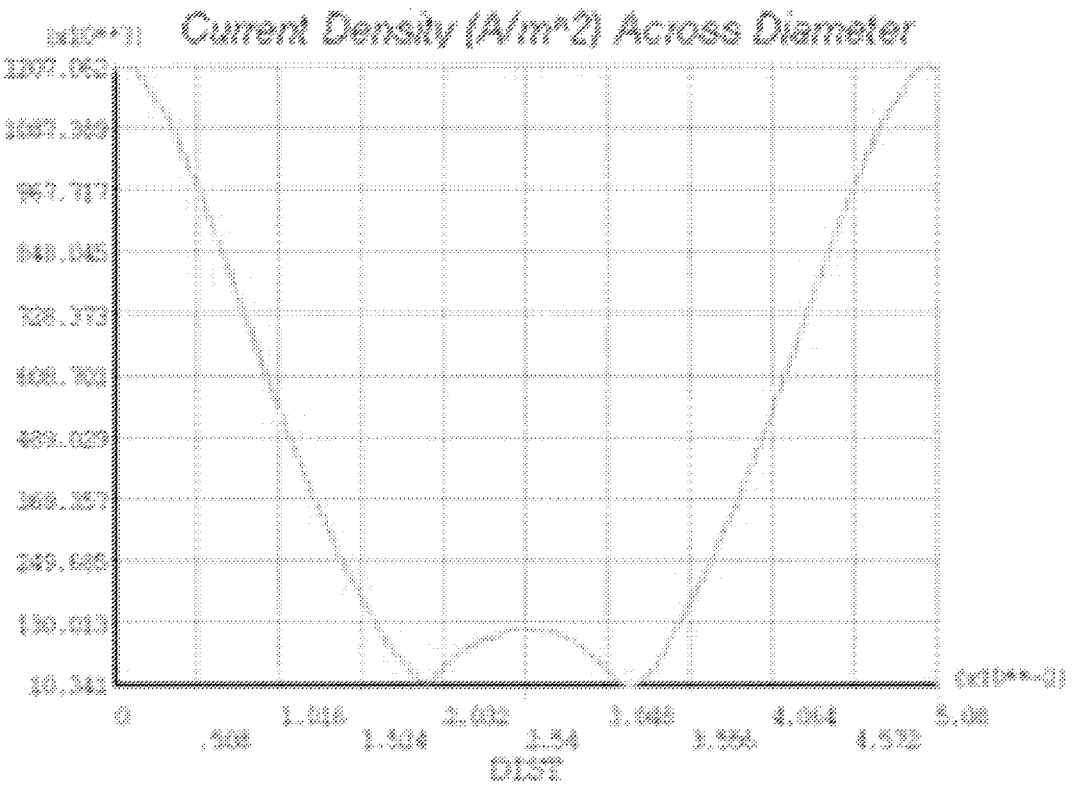
FIG. 2 depicts a graph of current density across diameter of a current lead according to an embodiment of the present disclosure.

FIG. 2 depicts a graph 200 of the magnitude of the current density across a diameter of a current lead according to an embodiment of the present disclosure. Referring to graph 200, it should be appreciated that current density may be higher near the outer surface of the current lead, and current density is lowest near the inner portions of the current lead.

"Skin depth" refers to a measure of depth at the current lead in which the skin effect takes place. Skin depth may refer to the depth at which current density falls to 1/e in the case of a planar geometry, where e may refer to a natural base of Napierian logarithms (e.g., 2.71828 of a value of depth near the surface).

Figure 3:
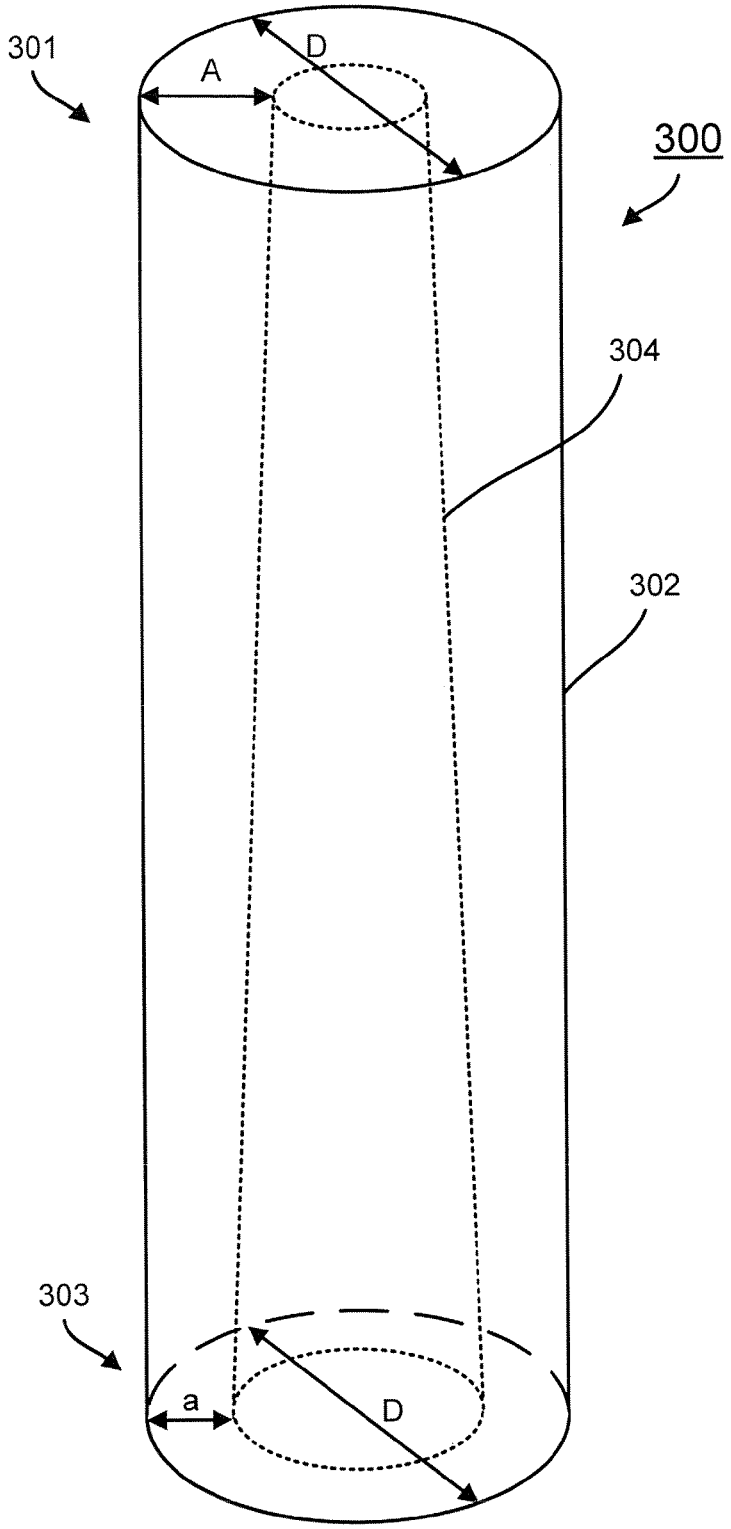
FIG. 3 depicts skin depth in a current lead according to an embodiment of the present disclosure.

FIG. 3 depicts a current lead 300 with non-uniform skin depth according to an embodiment of the present disclosure. As depicted in current lead 300, a conductive portion 302 of the current lead 300 may have a skin depth 304 that is not uniform along the current lead 300. If included in a system similar to the SCFCL system 100, the current lead 300 may be exposed to varying temperatures. For example, one part of the current lead (e.g. upper portion 301) may be outside the tank 112 and at a higher temperature (e.g. ambient temperature), whereas another part (e.g. lower portion 303) may be inside the tank 112 and at a lower temperature (e.g. cryogenic temperature). In such a case, skin depth of the current lead 300 may decrease from the upper portion 301 of the current lead 300 to the lower portion 303 of the current lead 300. As the skin depth decreases, there may be a decrease in an effective cross-sectional area of current flow.

As depicted in FIG. 3, it should be appreciated that the current lead 300 may have a cylindrical shape with a uniform diameter D. When an alternating electrical current (AC) at 60 Hz is applied, skin depth (A), at an upper portion 301 of the current lead 300 may be greater than skin depth (a) at a lower portion 303 of the current lead 300. It should be appreciated that at 60 Hz in a current lead made of copper, skin depth (A) may be in the range of approximately 8 to 8.5 mm at 300° K., and skin depth (a) may be approximately 3 mm at 77° K. At higher frequencies, the skin depth may be smaller in value.

Because interiors of large solid current leads generally carry small amounts of current, such current leads are typically very heavy, inefficient, and not cost-effective. Tubular, pipe-shaped current leads with hollow interiors may appear to resolve problems associated with skin depth, such tubular current leads, which are typically uniform in thickness throughout the current lead, may not readily address issues related to varying skin depth, as described above.

Figure 4:
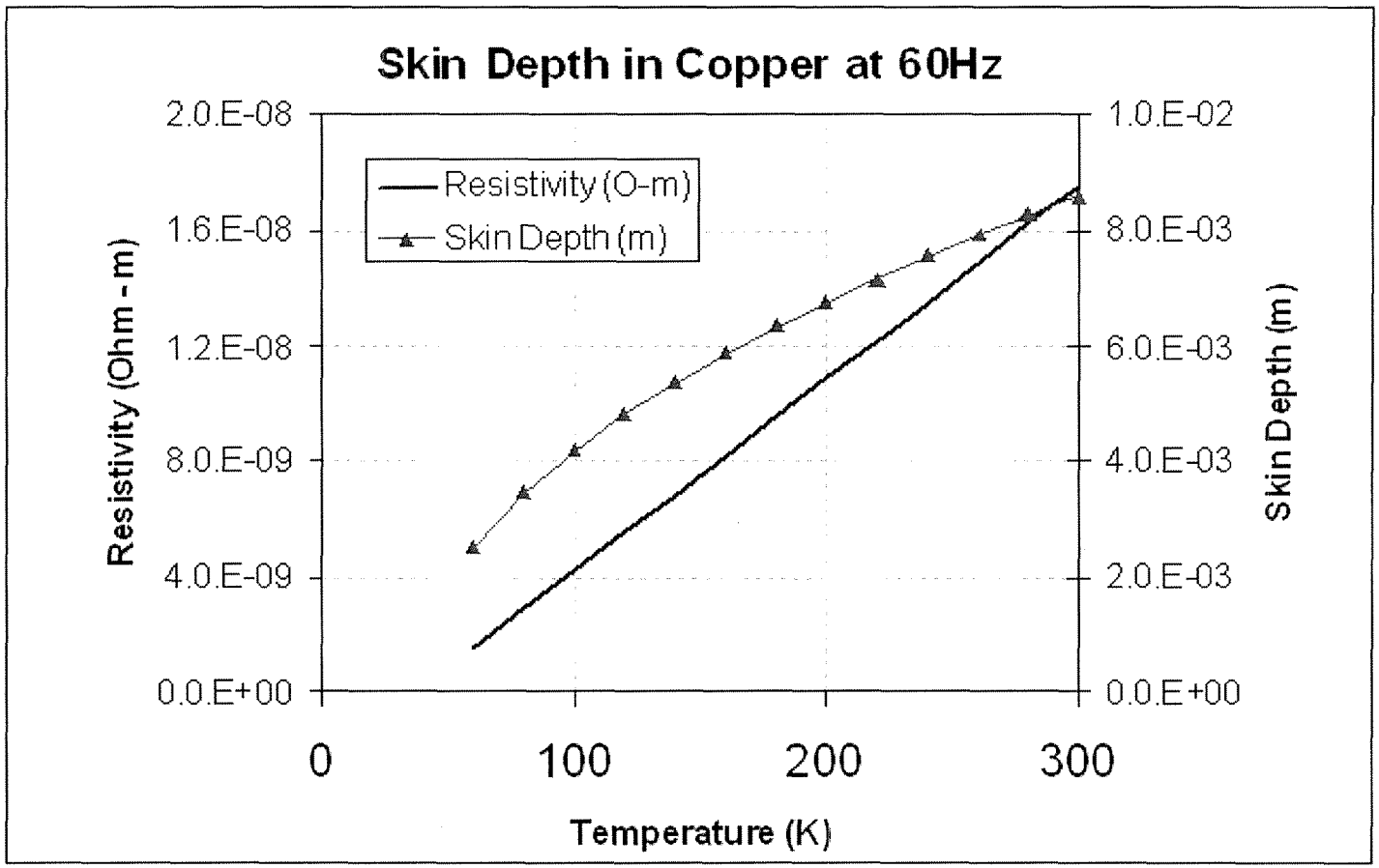
FIG. 4 depicts a graph showing skin depth of a copper current lead at 60 Hz according to an embodiment of the present disclosure.

FIG. 4 depicts a graph 400 showing skin depth of a copper current lead at 60 Hz according to an embodiment of the present disclosure. In graph 400, relationships between resistivity, temperature, and skin depth may exist for the copper current lead at 60 Hz. These relationships may be expressed as follows:

$$\text{Resistivity} \propto \text{Temperature}$$

$$\text{Skin Depth} \propto (\text{Resistivity})^{1/2}$$

It should also be appreciated that Joule heating (Q), also known as ohmic heating or resistive heating, may be exhibited in the current lead. Joule heating may refer to the process by which the passage of an electric current through a current lead releases heat. Heat produced at a current lead may be proportional to the square of the current multiplied by the electrical resistance of the current lead. This relationship may be expressed as follows:

$$Q \propto I^2 \cdot R$$

As described above, an SCFCL system 100 may comprises a current lead. Joule heat may be conducted through the current lead into the SCFCL system. If the SCFCL system includes a cryogen or coolant, joule heat may increase the boil-off rate of the cryogen or coolant. At the same time, the current lead may also provide a path to conduct heat away from an ambient environment and into the coolant system. As a result, a current lead with a large cross section may have little Joule heating but may impose greater thermal conductivity. In contrast, a thin current lead (e.g., with a small cross section) will provide less thermal conductivity but more Joule heating. Therefore, minimizing total heat load through a current lead may be achieved by optimizing the shape or configuration of the current lead.

Figure 5A:
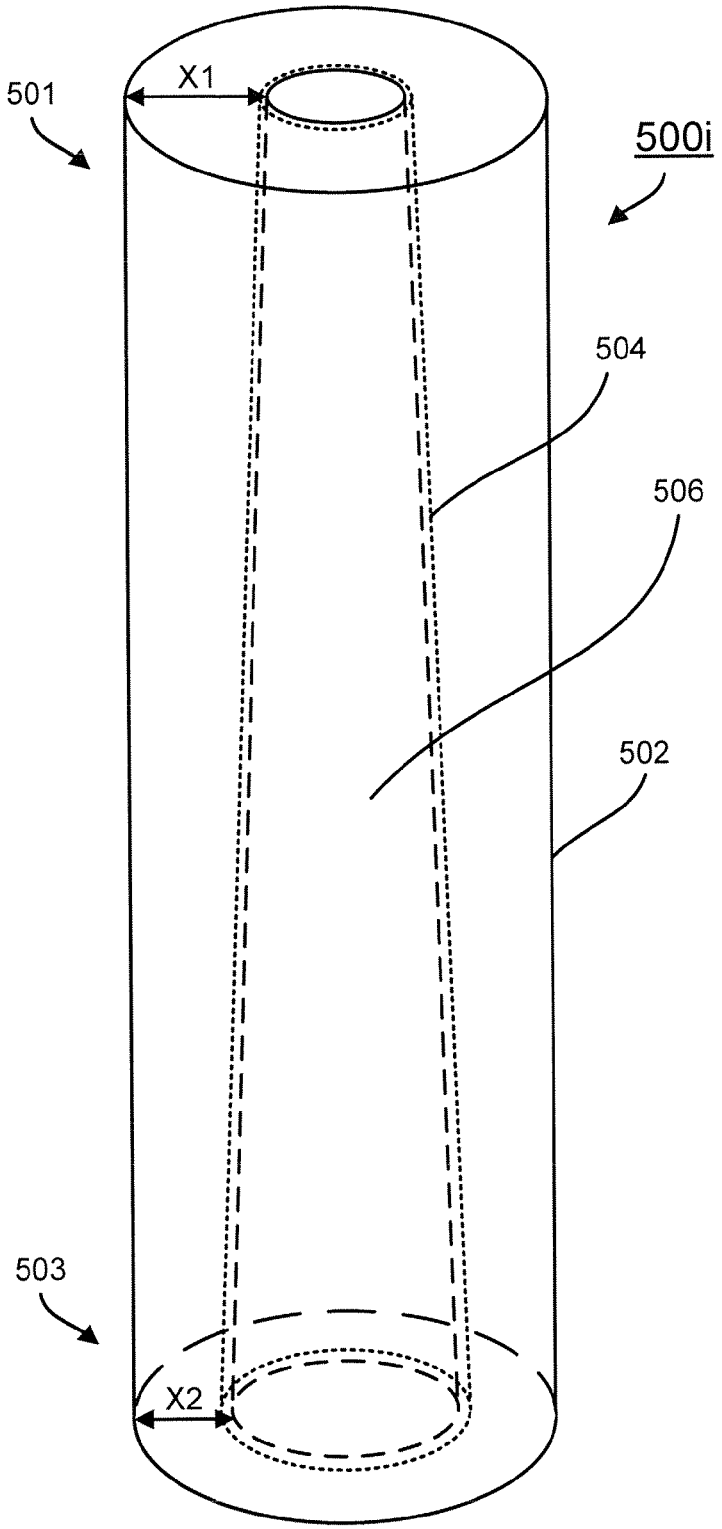
FIG. 5A depicts a current lead with an optimized configuration according to an embodiment of the present disclosure.

FIG. 5A depicts a current lead 500*i* with an optimized configuration according to an embodiment of the present disclosure. Referring to FIG. 5A, the current lead 500*i* may have an optimized shape for minimizing total heat load transfer. In this example, a conductive portion 502 of the current lead 500*i* may have a skin depth 504, which is similar to that of the current lead 300 depicted in FIG. 3. However, current lead 500*i* may have a hollow portion 506 that substantially corresponds with the skin depth 504. In other words, the thickness (X1) of the upper portion 500*i* of the current lead 500*i* may generally correspond to the skin depth (A) as shown in FIG. 3, and the thickness (X2) of the lower portion 503 of the current lead 500*i* may generally correspond to the skin depth (a) as shown in FIG. 3.

For a current lead made of copper at 60 Hz where the upper portion 501 resides at a temperature of about 300° K. and the lower portion 503 resides at a temperature of about 77° K., X may be approximately 8 to 8.5 mm and x may be approximately 3 mm. In this example, the outside diameter of the current lead may remain the same throughout. Only the hollow portion 506 of the current lead 500*i* may vary. In this example, the hollow portion 506 may be a smooth tapered shape that substantially corresponds to the skin depth of the current lead 500*i*.

With an optimized shape, a reduced cross sectional area of the current lead 500*i* may result in less heat conduction while maintaining overall joule heating since heat may be generated primarily in the skin depth areas of the conductive portion 502 of the current lead 500*i*. It should be appreciated that other various optimized configurations may also be provided.

Figure 5B:
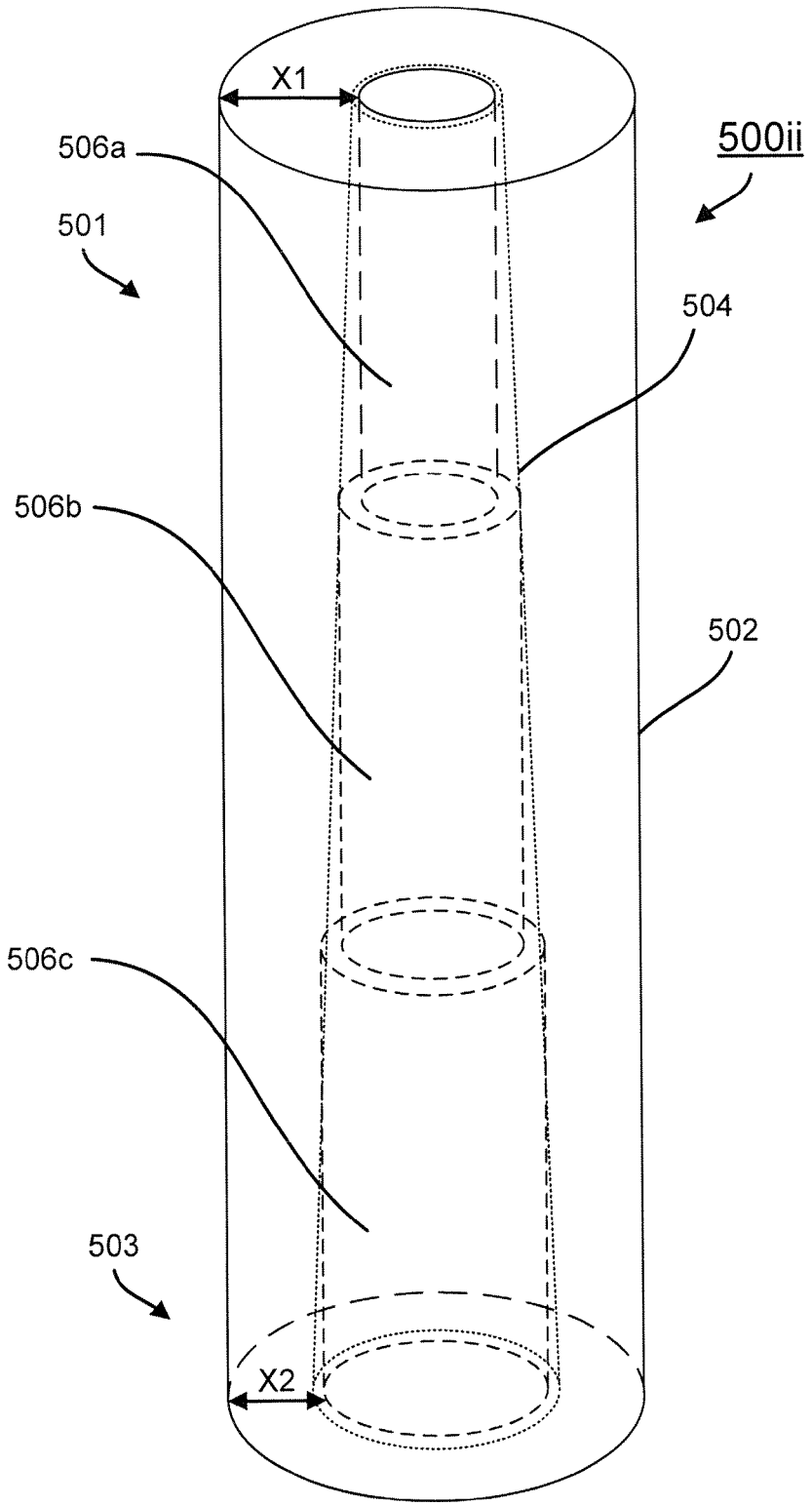
FIG. 5B depicts a current lead with an optimized configuration according to another embodiment of the present disclosure.

FIG. 5B depicts a current lead 500*ii* with an optimized configuration according to another embodiment of the present disclosure. Similar to the current lead 500*i* of FIG. 5A, the current lead 500*ii* may have a conductive portion 502 and a hollow portion 506. However, unlike current lead 500*i*, in which the hollow portion 506 is a smooth tapered shape, the current lead 500*ii* of FIG. 5B may have a hollow portion with multiple segments. In this example, the segmented hollow portion may comprise of a first hollow portion 506*a*, a second hollow portion 506*b*, and a third hollow portion 506*c*. Each of these hollow portions 506*a*, 506*b*, and 506*c* may be cylindrical in shape. When stacked together within the current lead 500*ii*, the overall segmented hollow portion may roughly correspond with the skin depth 504 of the current lead 500*ii*, thereby achieving roughly similar effects and advantages of the smoother tapered shape of the hollow portion 506 of the current lead 500*i* in FIG. 5A.

An advantage of providing a segmented hollow portion may be realized in cost-savings resulting from streamlined manufacturing of current leads. For example, the current lead 500*ii* may be formed by combining three distinct current leads to form a single integrate current lead. Because each of the three current leads each having a hollow portion segment 506*a*, 506*b*, or 506*c* may be manufactured in large quantities, separately and independently of each other, cost for manufacture may be greatly reduced. Furthermore, having the ability to piece together current leads with different hollow portions of various sizes, shapes, and configurations provides additional flexibility and customizations not otherwise achievable.

It should be appreciated that while only three hollow portions 506*a*, 506*b*, and 506*c* are depicted in FIG. 5B, a greater or lesser number of hollow portion segments may be provided. A greater number of segments may result in a current lead with a hollow portion that more substantially corresponds to skin depth. A lesser number of segments may result in a current lead with a hollow portion that more roughly corresponds to skin depth, but may be more cost-effective to manufacture.

Figure 5C:
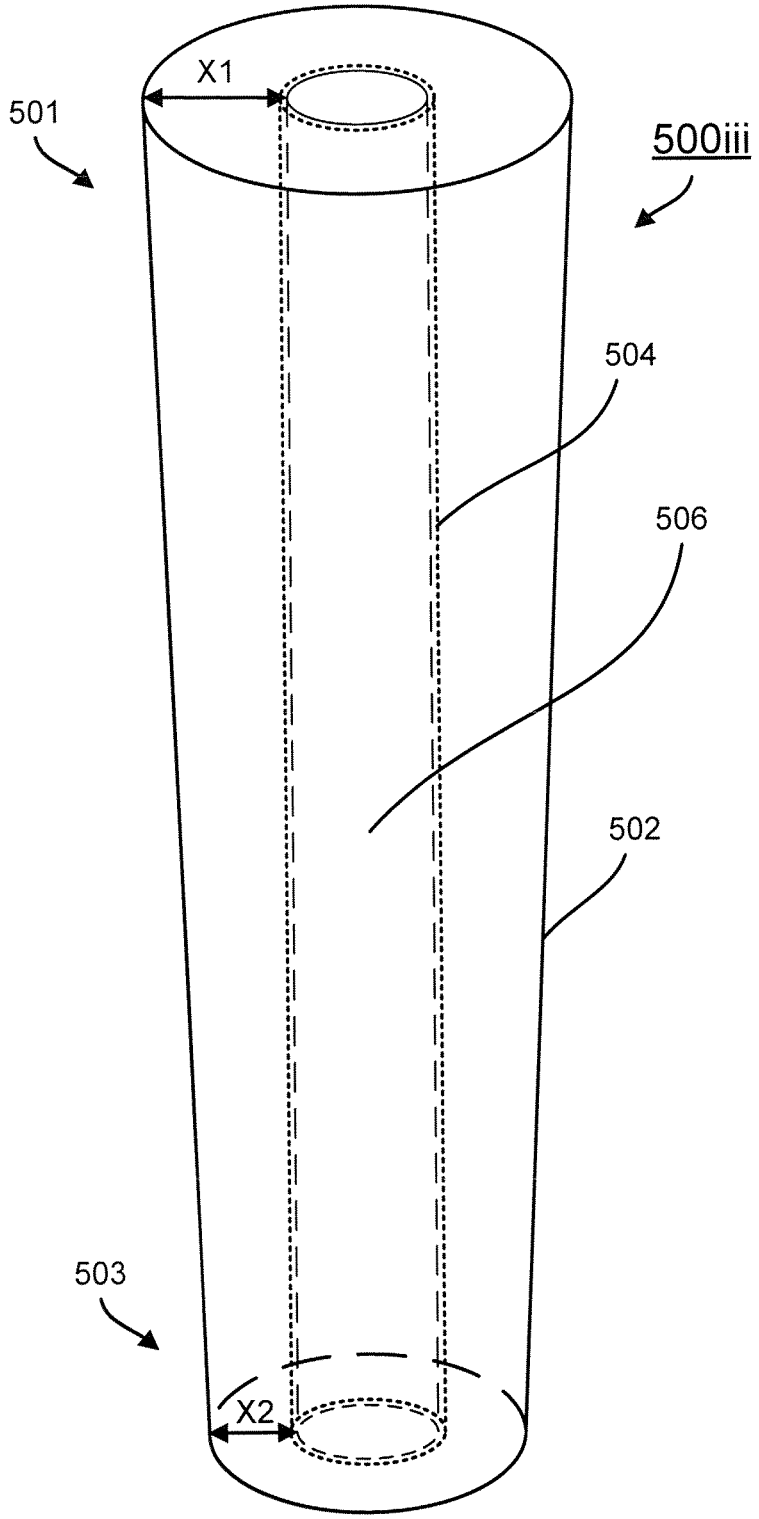
FIG. 5C depicts a current lead with an optimized configuration according to another embodiment of the present disclosure.

FIG. 5C depicts a current lead 500*iii* with an optimized configuration according to another embodiment of the present disclosure. Similar to the current lead 500*i* of FIG. 5A, the current lead 500*ii* may have a conductive portion 502 and a hollow portion 506. However, unlike current lead 500*i*, in which the hollow portion 506 is a smooth tapered shape, the current lead 500*iii* of FIG. 5C may have a hollow portion 506 that is a non-tapered and cylindrical in shape. In addition, the conductive portion 502 of the current lead 500*iii*, unlike current lead 500*i*, may be tapered. For example, an upper portion 501 of the current lead 500*iii* may have a larger cross-sectional area and thickness (X1) compared to a lower portion 503 of the current lead 500*iii*, which may have a smaller cross-sectional area and thickness (X2).

It should be appreciated that having a cylindrical hollow portion 506 and a tapered conductive portion 502 may provide ease of manufacture and other cost-effective measures.

Figure 5D:
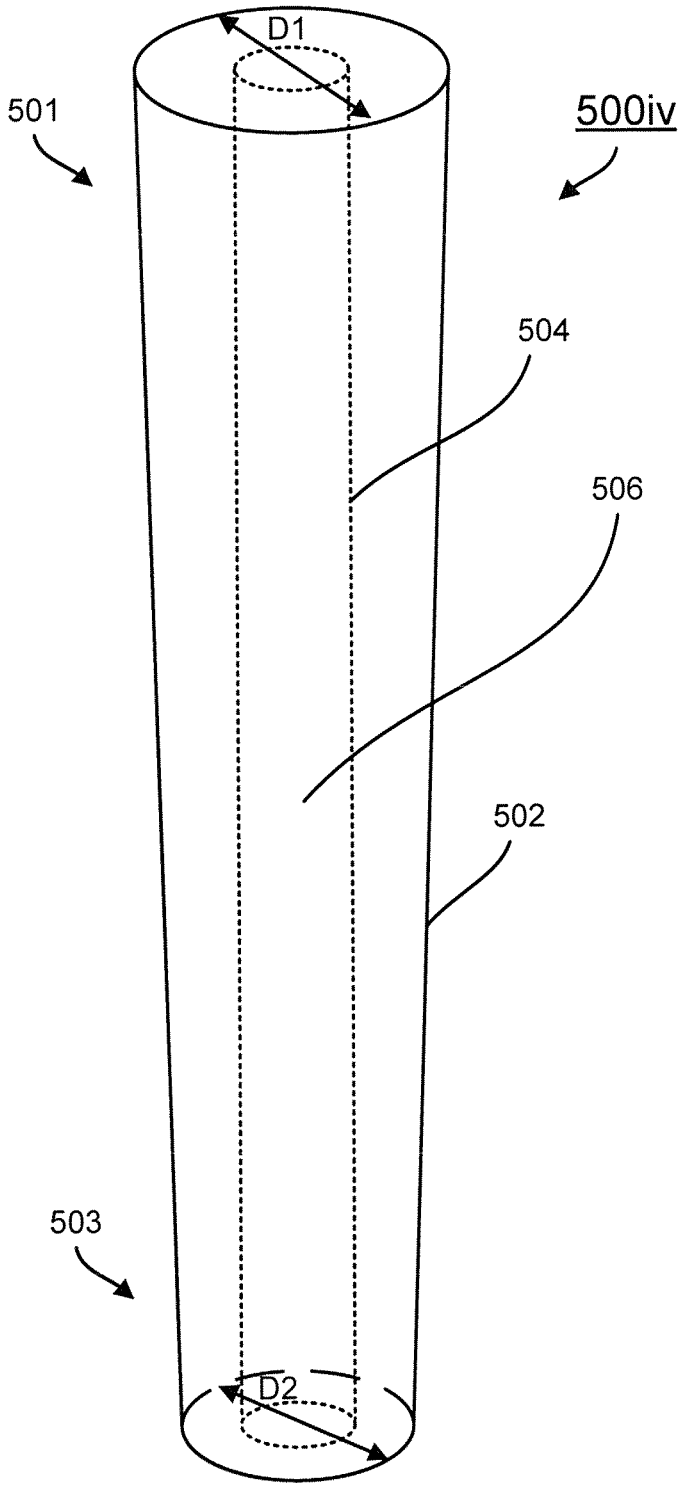
FIG. 5D depicts a current lead with an optimized configuration according to another embodiment of the present disclosure.

FIG. 5D depicts a current lead 500*iv* with an optimized configuration according to another embodiment of the present disclosure. Referring to FIG. 5D, the current lead 500*iv* may have an optimized shape for minimizing total heat load transfer. In this example, a conductive portion 502 of the current lead 500*iv* may have a skin depth 504, which is similar to that of the current lead 300 depicted in FIG. 3. However, instead of having a hollow portion, the current lead 500*iv* may have a solid core and a conductive portion 502 that is tapered. For example, an upper portion 501 of the current lead 500*iv* may be thicker having a diameter (D1) and a lower portion 503 of the current lead 500*iv* may be thinner having a diameter (D2), where D1 is greater than D2. As a result, the skin depth 504 may have a substantially cylindrical shape. In other words, the skin depth 504 may remain non-uniform along the current lead 500*iv*, similar to that of the current lead 500*i* of FIG. 3, but because the conductive portion 502 of the current lead 500*iv* is tapered, the skin depth 504 found in current lead 500*iv* may appear uniform along the current lead 500*iv*. Here, the conductive portion 502 of the current lead 500*iv* may be tapered in such a way to maintain the relative cylindrical shape of the skin depth 504 along the current lead 500*iv*.

It should be appreciated that while embodiments described above are directed to several configurations for a current lead or for a hollow portion of a current lead, other various configurations and shapes may also be provided. For example, a hollow portion of a current lead may have a segmented shape using tapered hollow segments instead of cylindrical hollow segments. A current lead may also have a hollow portion with a spirally tapered shape that may be created using a screw or other similar component to define the shape within the current lead. A current lead may also have a segmented exterior shape, a tapered configuration, or a combination thereof Other various configurations, shapes, variations, and combinations thereof may also be provided.

Since the skin depth is a function of electrical current frequency, it should be appreciated that a variety of other configurations may be provided by calculating skin depth and using these calculations to guide design of a current lead according to the electrical current frequency applied.

In some embodiments, one or more electrical inputs at one or more points along a length of a current lead may be provided. In some other embodiments, one or more electrical outputs at one or more points along a length of a current lead may be provided. By providing one or more inputs and/or one or more outputs along the length of the current may provide greater flexibility and control over skin depth and overall reduction of heat loss.

It should be appreciated that while the above embodiments have been described where the conductive material is copper, other conductive materials may also be provided. These may include, but not limited to, aluminum, silver, steel, etc.

Although not depicted in FIGS. 5A-5D, one or more insulators or coatings may also be provided to the current lead 500*i*, 500*ii*, 500*iii*, or 500*iv*. The one or more insulators or coatings may be provided on the outside, inside, or a combination thereof at the current lead. In some embodiments, the one or more insulators or coatings may have low thermal conductivity and capability to withstand low temperature (e.g., cryogenic temperature). In some embodiments, the one or more insulators or coatings may be formed of various materials or composites, such as, but are not limited to, glass, plastics, rubbers, epoxy, epoxy based composite, Teflon, and air.

It should also be appreciated that while embodiments of the present disclosure are directed to applications in a superconducting fault current limiter (SCFCL) system, other various applications and implementations may also be provided, such as superconductive magnets, superconductive energy storage, and other superconducting applications or other applications using current leads.

By providing a current lead with an optimized configuration, heat load transfer may be reduced, especially in alternating electrical current (AC) applications. Furthermore, optimization of current lead configuration may provide flexibility, customization, cost savings, and ease of manufacture.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A current lead comprising:

a conductive material having a configuration for reducing heat load transfer across the current lead when an alternating electrical current (AC) is applied to the current lead, the current lead comprising a first portion configured to operate at a first temperature and a second portion configured to operate at a second temperature higher than the first temperature, wherein temperature gradient is exhibited along a length of the current lead, wherein the conductive material surrounds an inner portion, the conductive material in the first portion having a first thickness that extends from a surface of the first portion to a surface of the inner portion, the conductive material in the second portion having a second thickness that extends from a surface of the second portion to the surface of the inner portion, and the second thickness being greater than the first thickness.

2. The current lead of claim 1, wherein at least one of the conductive material and the configuration comprises temperature-dependent characteristics associated with joule heating and conduction to reduce heat load transfer.

3. The current lead of claim 1, wherein the current lead is made of two or more materials bonded along a length of the current lead to reduce heat load transfer.

4. The current lead of claim 1, wherein the inner portion comprises a hollow portion, wherein the conductive material comprises a cylindrical shape and the configuration comprises the hollow portion being surrounded by the conductive material.

5. The current lead of claim 4, wherein the hollow portion comprises a tapered conical shape.

6. The current lead of claim 4, wherein the hollow portion comprises a stepped, conical shape having two or more segments.

7. The current lead of claim 4, wherein the current lead is an integrated current lead formed by two or more independent current leads along a length of the integrated current lead, wherein each of the two or more independent current leads has an overall cross-sectional diameter that is approximate to the other independent current leads.

8. The current lead of claim 1, wherein the inner portion comprises a hollow portion, wherein the optimized configuration comprises the conductive material being a tapered conductive material that surrounds the hollow portion.

9. The current lead of claim 1, wherein the optimized configuration comprises a tapered conductive material.

10. The current lead of claim 9, wherein the insulating material is attached to at least part of the outer surface of the tapered conductive material.

11. The current lead of claim 1, further comprising an insulating material configured to cover at least part of a surface of the current lead.

12. The current lead of claim 1, wherein current lead is configured for use m a superconducting (SC) system.

13. The current lead of claim 12, wherein the superconducting (SC) system comprises at least one of a superconducting fault current limiter (SCFCL) system, a superconducting (SC) magnet system, and a superconducting (SC) storage system.

14. The current lead of claim 1, wherein the current lead is an integrated current lead formed by two or more independent current leads along a length of the integrated current lead.

15. The current lead of claim 1, wherein the current lead has different shapes for different alternating electrical current (AC) input frequencies.

16. The current lead of claim 1, further comprising one or more electrical inputs at one or more points along a length of the current lead, and one or more electrical outputs at one or more points along the length of the current lead.

17. An superconducting (SC) system comprising:

a conductive material having a configuration for reducing heat load transfer across a current lead when an alternating electrical current (AC) is applied to the current lead, the current lead comprising a first portion configured to operate at a first temperature and a second portion configured to operate at a second temperature higher than the first temperature, wherein temperature gradient is exhibited along a length of the current lead, wherein the conductive material surrounds an inner portion, the conductive material in the first portion having a first thickness that extends from a surface of the first portion to a surface of the inner portion, the conductive material in the second portion having a second thickness that extends from a surface of the second portion to the surface of the inner portion, and the second thickness being greater than the first thickness.

18. The superconducting (SC) system of claim 17, wherein the configuration comprises a hollow portion that is surrounded by the conductive material, wherein the conductive material comprises a tapered conductive material, wherein the hollow portion comprises at least one of a tapered conical shape and a stepped, conical shape having two or more segments, and the tapered conductive material comprises at least one of a smooth taper and a stepped taper.

19. The superconducting (SC) system of claim 18, wherein the current lead is an integrated current lead formed by two or more independent current leads along a length of the integrated.

20. A method of manufacturing a current lead, the method comprising:

providing a first current lead, the first current lead comprising:

a first conductive material having a first hollow portion, wherein the first conductive material and the first hollow portion are cylindrical in shape, wherein a diameter of the first conductive material is greater than a diameter of the first hollow portion;

providing a second current lead, the second current lead comprising:

a second conductive material having a second hollow portion, wherein the second conductive material and the second hollow portion are cylindrical in shape, wherein a diameter of the second conductive material is greater than a diameter of the second hollow portion, and wherein the diameter of the first conductive material is the same as the diameter of the second conductive material and the diameter of the first hollow portion is different than the diameter of the second hollow portion; and attaching the first current lead with the second lead at respective ends of each of the first current lead and the second current lead to form an integrated current lead with a configuration for reducing heat load transfer across the integrated current lead when an alternating electrical current (AC) is applied to the integrated current lead, wherein temperature fluctuation or gradient is exhibited along a length of the integrated current lead.

21. The method of claim 20, further comprising:

providing a third current lead, the third lead comprising:

a third conductive material having a third hollow portion, wherein the third conductive material and the third hollow portion are cylindrical in shape, wherein a diameter of the third conductive material is greater than a diameter of the third hollow portion, and wherein the diameter of the second conductive material is the same as the diameter of the third conductive material and the diameter of the third hollow portion is different than the diameter of the first and second hollow portions; and attaching the third current lead to the second current lead at respective ends of each of the second current lead and the third current lead to form an integrated current lead with a configuration for reducing heat load transfer.

* * * * *